US005193454A

United States Patent [19]

Bollegraaf

[11] Patent Number: 5,193,454

[45] Date of Patent: Mar. 16, 1993

[54] BALING PRESS WITH PREPRESS VALVES

[75] Inventor: Heiman S. Bollegraaf, Appingedam, Netherlands

[73] Assignee: H.S. Bollegraaf-Holding, B.V., Netherlands

[21] Appl. No.: 650,039

[22] Filed: Feb. 4, 1991

[30] Foreign Application Priority Data

Mar. 20, 1990 [NL] Netherlands ..... 9000643

[51] Int. Cl.[5] ..... B30B 15/20

[52] U.S. Cl. ..... 100/142; 100/215; 100/232

[58] Field of Search ..... 100/137, 141, 142, 143, 100/190, 215, 232, 233, 295, 901, 244, 264; 141/171, 173, 180; 222/502, 503

[56] References Cited

U.S. PATENT DOCUMENTS

| | | | |
|---|---|---|---|
| 1,967,845 | 7/1934 | Streun | 222/503 |
| 2,403,536 | 7/1946 | Lewis | 222/503 |
| 2,932,244 | 4/1960 | Moyer | 100/901 |
| 2,995,999 | 8/1961 | Holt | 100/901 |
| 3,174,425 | 3/1965 | Eby | 100/142 |
| 3,479,950 | 11/1969 | Freeman | 100/49 |
| 3,780,646 | 12/1973 | Ancellin | 100/143 |
| 3,858,504 | 1/1975 | Boyer | 100/215 |
| 4,043,491 | 8/1977 | Johnson | 222/503 |
| 4,059,049 | 11/1977 | Tillgren | 100/137 |
| 4,594,942 | 6/1986 | Denneboom | 100/137 |

FOREIGN PATENT DOCUMENTS

| | | | |
|---|---|---|---|
| 0080719 | 6/1983 | European Pat. Off. . | |
| 0178767 | 4/1986 | European Pat. Off. . | |
| 21705 | 6/1968 | Japan | 100/901 |
| 623051 | 11/1935 | Netherlands | 100/143 |
| 836550 | 6/1960 | United Kingdom . | |
| 1220844 | 5/1968 | United Kingdom . | |
| 1400100 | 7/1975 | United Kingdom . | |

*Primary Examiner*—Harvey C. Hornsby
*Assistant Examiner*—Terrence R. Till
*Attorney, Agent, or Firm*—Merchant, Gould, Smith, Edell, Welter & Schmidt

[57] ABSTRACT

A baling press provided with a pressing box, a feed chute connected with the pressing box via a passage, at least two prepress valves. The prepress valves are each pivotable about a pivotal axis, provided with a flat wall which in closed position closes off the passage from the feed chute to the pressing box and in opened position is disposed in the wall of the feed chute, and with a surface substantially curved about the corresponding pivotal axis, which surface in closed position bounds the feed chute in axial direction. One of the prepress valves is provided with a connecting surface which in the closed position is curved about a pivotal axis of one other of the prepress valves. In that closed position, the connecting surface is disposed at a distance from the curved surface of said other prepress valve which is at most minor and substantially constant. The invention provides a possibility of avoiding material to be pressed getting stuck between the prepress valves when the prepress valves are being closed.

5 Claims, 5 Drawing Sheets

BEST AVAILABLE COPY

BEST AVAILABLE COPY

BALING PRESS WITH PREPRESS VALVES

Figure 1:
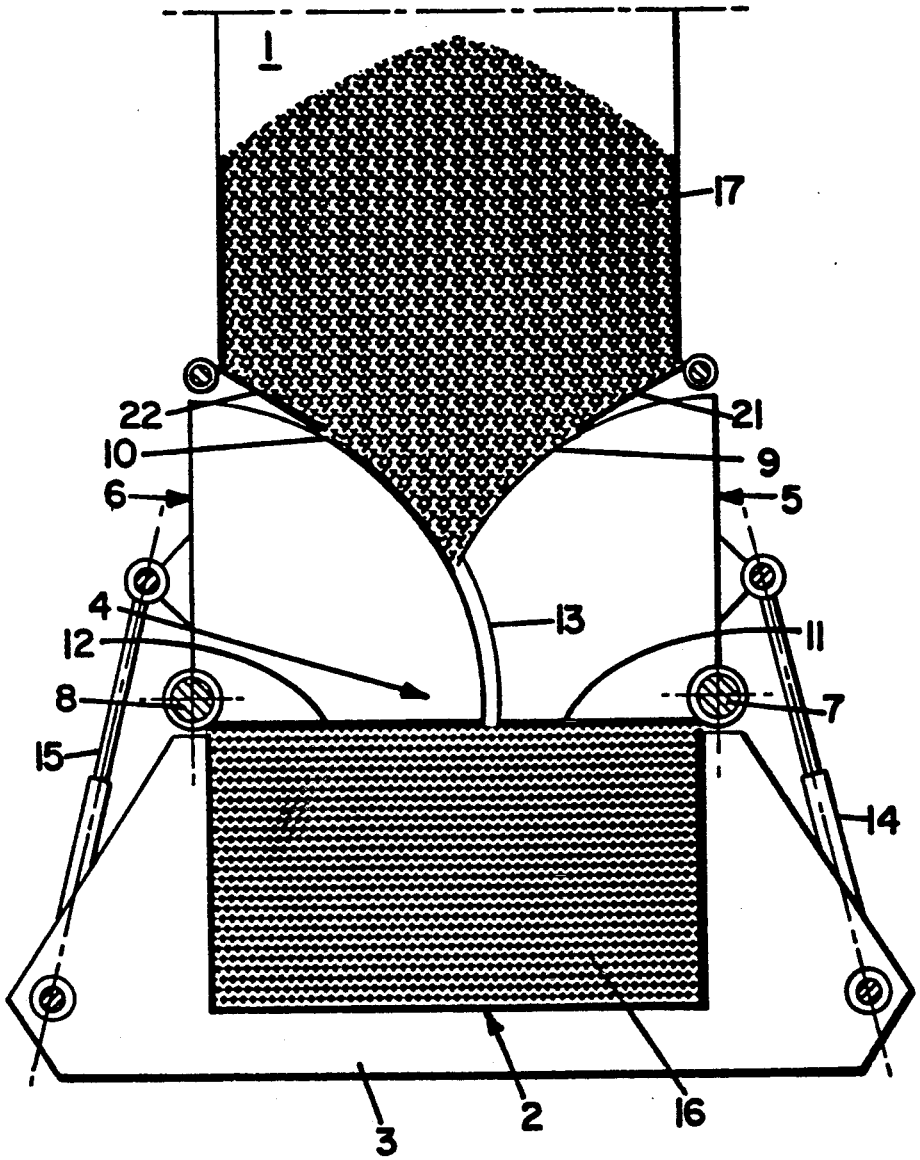

This invention relates to a baling press comprising a pressing box, a feed chute connected to the pressing box via a passage, at least two prepress valves which are each pivotable about a pivotal axis, are provided with a flat wall which in closed position closes off the passage from the feed chute to the pressing box and in opened position is disposed in the wall of the feed chute, and with a surface substantially curved around the corresponding pivotal axis, which surface in closed position bounds the feed chute in axial direction.

Such a press is known from U.S. Pat. No. 4,594,942 and is intended for pressing into bales bulk material such as (waste) paper, plastic, rags and household refuse. This press is provided with two prepress valves which are pivotable about parallel oppositely arranged pivotal axes on opposite sides of the feed chute. By means of these prepress valves any material which after being supplied to the pressing box still projects from the pressing box can be forced into the pressing box when the prepress valves are being closed. Thus the material is prepressed in the pressing box, so that a proper packing of the pressing box is obtained.

A drawback of such a construction is that when the material to be pressed comprises larger, poorly compressible components, such as telephone directories in the case where waste paper is being processed, such poorly compressible components may get stuck between those prepress valves when the prepress valves are being closed, with the result that the prepress valves cannot be closed or opened. The construction described in the U.S. patent specification referred to is provided with prepress valves whose pivotal axes can be moved apart, so that in the case where a poorly compressible component gets stuck, the prepress valves can nevertheless be closed and subsequently opened. Such a construction is complicated and expensive. Functionally speaking, this construction moreover carries with it the drawback that a stuck, poorly compressible component may stick out in the pressing box during pressing and may thus prevent a proper bale formation as well as the passage of the press member in the pressing box.

The object of the invention is to provide an apparatus of the type described hereinabove, in which the problem of poorly compressible components getting stuck between the prepress valves does not arise.

This object is accomplished according to the invention, owing to the fact that at least one of the prepress valves comprises at least one connecting surface, which in closed position is curved around at least one pivotal axis of one other of the prepress valves and is adapted to the at least one, curved surface of one other of the prepress valves, in such a way that in the closed position the connecting surface and the curved surface of the at least one other prepress valve are disposed at a mutual distance that is at most minor and substantially constant.

In operation, each time the prepress valve which is provided with the connecting surface is first closed completely, after which the at least one other valve is closed. Closing of the other valve must be performed so much later that the radially outer edge of said other valve reaches the area where during closing of the prepress valves material to be pressed may be present, after the prepress valve provided with the connecting surface has been closed completely. Thus it is accomplished that when the prepress valves are being closed, oppositely disposed portions of the prepress valves, which poorly compressible components of the material to be pressed might get stuck between, do not move towards each other within reach of the material to be pressed. Material that is being prepressed during closing of said other valve can shift along said connecting surface.

The baling press according to the invention may be provided with two or more prepress valves, of which at least one is provided with at least one connecting surface. Preferably, the baling press is provided with two oppositely arranged prepress valves, with the connecting surface being curved around the pivotal axis of the oppositely arranged prepress valve.

It is observed that the feed chute need not be constructed exclusively as a feed chute, but may for instance be provided with means for distributing, reducing or prepressing the material to be pressed against the prepress valve. A screw conveyor for prepressing the material to be pressed is described inter alia in German patent specification no. 29 44 328 in applicant's name.

Figure 3:
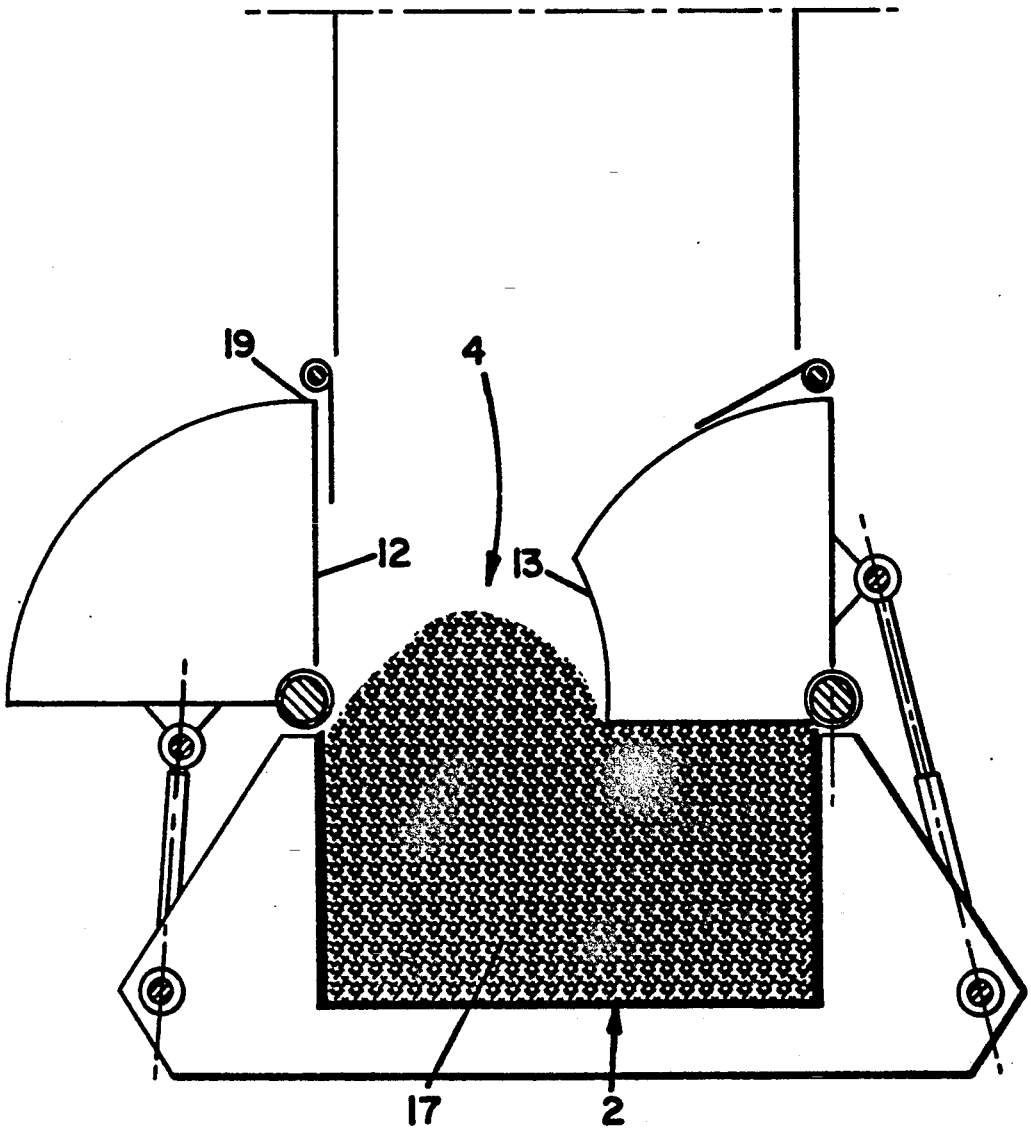
Figure 4:
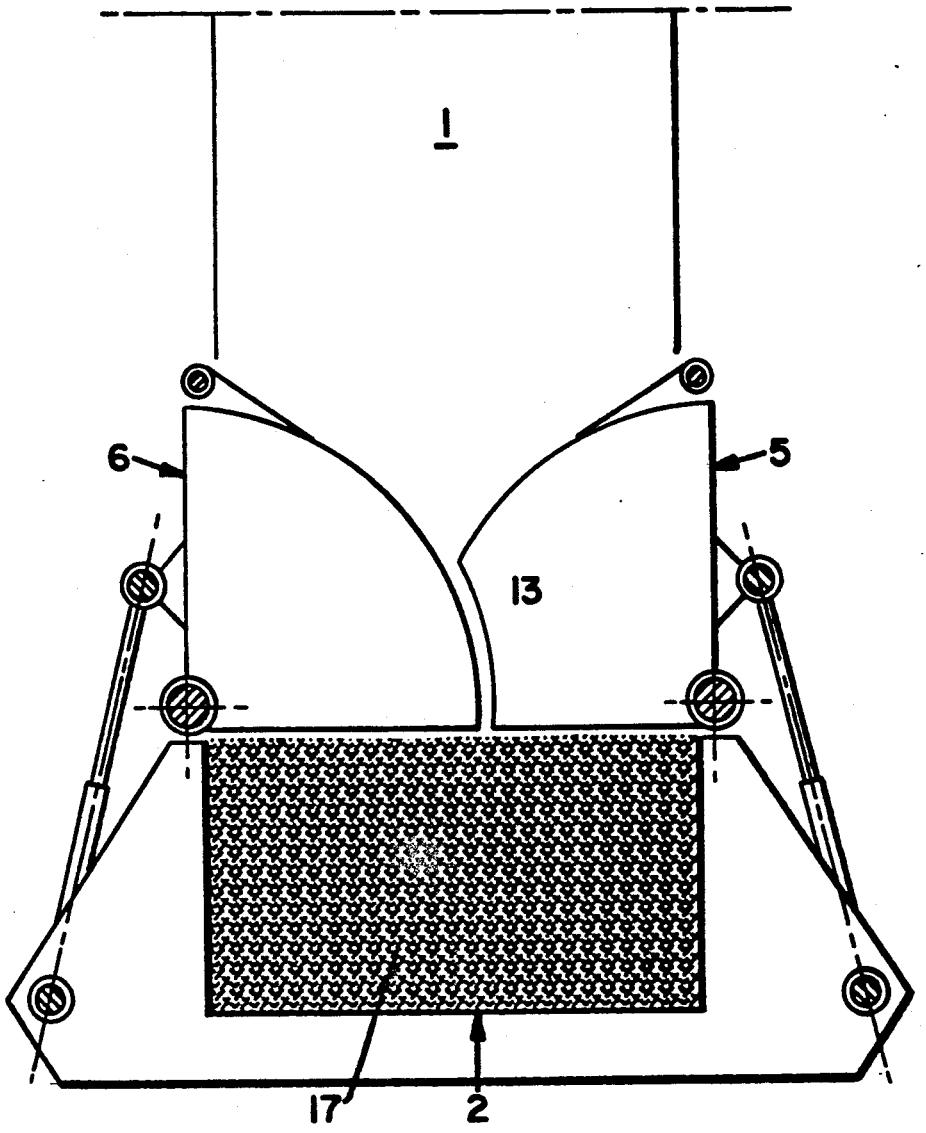
Figure 5:
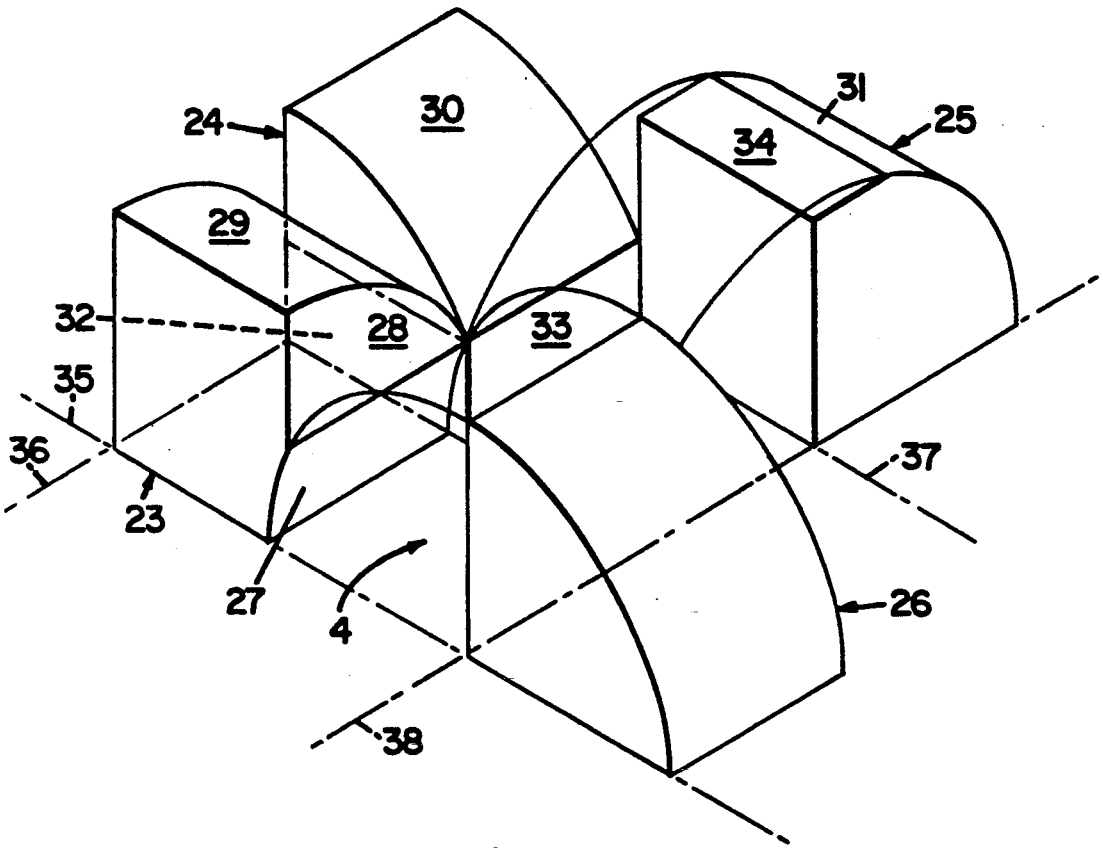

Some embodiments of the invention will now be further illustrated and explained with reference to the accompanying drawings, in which:

FIGS. 1–4 are sectional side-elevational views of a baling press according to the invention in four successive stages of operation; and FIG. 5 is a perspective representation of the principle of an alternative embodiment of the invention.

Figure 2:
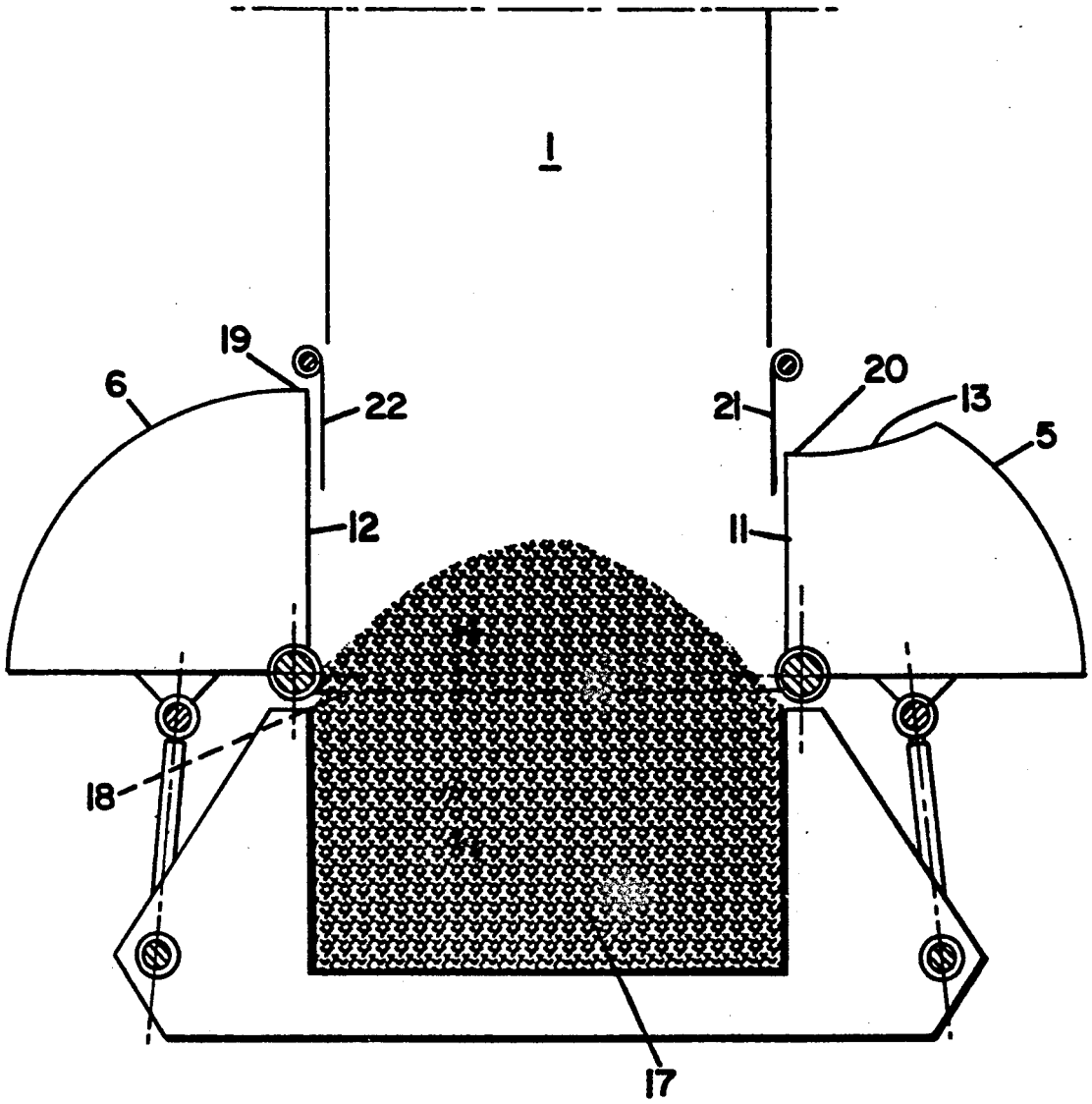

The baling press shown in FIGS. 1–4 comprises a feed chute 1 which terminates in a pressing box 2 and is shown in longitudinal section, which extends perpendicularly to the plane of section. The pressing box 2 is enclosed in frames 3, of which one is shown in the drawings. The feed chute 1 is connected with the pressing box 2 via a passage 4. Mounted at the end of the feed chute 1 on the side of the pressing box 2 are a first and a second prepress valve 5 and 6, respectively. The prepress valves 5 and 6 are each pivotable around an axis 7 and 8, respectively, between a closed position (FIGS. 1 and 4) and an opened position (FIG. 2). The two pivotal axes 7 and 8 are of mutually parallel orientation and oppositely arranged on opposite sides of the feed chute. Instead of being arranged at the wall of the feed chute 1, the pivotal axes 7 and 8 may also be arranged at some distance therefrom. Further, the prepress valves 5 and 6 are each provided with a surface 9, 10, respectively, substantially curving with the respective pivotal axes 7, 8, as well as with flat walls 11, 12, which in closed position close off the passage 4 and in opened position form an extension of the wall of the feed chute 1. In closed position the surfaces 9 and 10 curved with the respective pivotal axes 7 and 8, close off the feed chute 1 in axial direction.

The first prepress valve 5 is provided with a connecting surface 13, which in the closed position of that prepress valve 5, is curved around the pivotal axis of the second prepress valve 6 and extends at a minor distance from the curved surface 10 of the oppositely disposed prepress valve 6.

The prepress valves 5 and 6 can be operated by means of hydraulic cylinders 14 and 15, which are mounted on the frames 3.

FIG. 1 shows the baling press in a stage where pressing a bale 16 has been completed, which compressed bale 16 is shown in elevational view. During the pressing of the bale 16 a quantity of material 17 to be pressed has been supplied above the prepress valves 5 and 6.

Then the material 17 to be pressed is partly allowed to pass into the pressing box by opening the prepress valves 5 and 6 (FIG. 2).

A portion of the material 17 to be pressed projects above the upper edge 18 of the pressing box 2 and must be pressed into the pressing box 2 for baling. As shown in FIG. 3, for this purpose first the first prepress valve 5 is closed, and thus a portion of the material 17 to be pressed that projects outside the pressing box is pressed into the pressing box. After that prepress valve 5 has been closed completely, a part of the connecting surface 13 extends above the material 17 to be pressed, so that the flat wall 12 of the second prepress valve 6, when that prepress valve is being closed, has its edge 19 remote from the pivotal axis passing along the first prepress valve 5 at a minor, approximately constant distance until the closed position is achieved (FIG. 4). Thus the material 17 to be pressed is moved along the connecting surface 13 and will not get stuck between the prepress valves 5 and 6.

After the prepress valves 5 and 6 have been closed, the material 17 chuted into the pressing box 2 can be compressed to form a bale and simultaneously new material to be pressed can be dumped into the feed chute 1, after which the stage shown in FIG. 1 is reached again.

The connecting surface 13 is preferably formed as a concave cylinder sector. Such a form is easy to manufacture and allows minimal construction height in a baling press provided with two prepress valves 5 and 6.

The distance between the connecting surface 13 and the curved surface 10 of the second prepress valve 6 is preferably 20–50 mm. On one hand, with such a clearance a sufficient sealing of the pressing box 2 is achieved and, on the other, such clearance prevents a situation where material that has deposited on the connecting surface 13 and the oppositely disposed portion of the curved surface 10 of the second prepress valve 6 may cause undue friction between the two prepress valves 5 and 6.

Mounted for hinging movement above the prepress valves 5 and 6 are screening plates 21 and 22 which in opened position connect to the wall of the feed chute 1 substantially in alignment therewith, and extend beyond that edge 19, 20 of the flat wall 11, 12 of the prepress valves 5, 6 which is remote from the pivotal axis 7, 8 of the prepress valve 5, 6, respectively. In the closed position the screening plates 21 and 22 are in contact with the curved surfaces 9, 10 of the prepress valves 5, 6 in a position where they point away from the feed chute 1. When the prepress valves 5, 6 are in the opened position, the screening plates 21, 22 screen the interspace between the flat walls 11, 12 of the prepress valves 5 and 6 and the walls of the feed chute 1 adjacent thereto. This is advantageous, particularly for closing off the interspace adjacent to the first prepress valve 5, because this interspace is relatively large. An additional advantage of the screening plates 21, 22 is that when the prepress valves 5, 6 are being opened, the plates can scrape off any material that has deposited on the curved surfaces 9, 10 from those curved surfaces 9, 10. This is advantageous, in particular for the portion of the curved surface 10 of the second prepress valve that is disposed opposite the connecting surface 13 in the closed position of the prepress valves 5, 6, because this avoids any material that has deposited on that portion during the closing of the second prepress valve 6 jamming against the connecting surface 13 disposed at a minor interspace.

In the embodiment described above the pivotal axes 7, 8 are oriented parallel to the longitudinal axis of the pressing box 2. However, it is also possible to arrange prepress valves in such a way that the pivotal axes thereof extend transversely to the longitudinal axis of the pressing box. One embodiment in which the pivotal axes are oriented both parallel to and transverse to the longitudinal axis of the pressing box will be described hereinafter.

In the area of a passage 4 a system of four prepress valves 23, 24, 25 and 26 may be arranged, as shown in FIG. 5. The prepress valves 23, 24, 25 and 26 are pivotable on axes 35, 36, 37 and 38, respectively. Of the four prepress valves, the first two valves 23 and 24 are shown in closed position and the third and the fourth valve 25 and 26 in the opened position. The connecting surface 27 is provided in a side wall 28 of a first prepress valve 23. Adjoining each of the curved surfaces 29, 30 and 31 of the first three of the four prepress valves is a flat connecting surface 32, 33 and 34, respectively. When the prepress valves 23, 24, 25 and 26 are to be closed, first the first and then the second, the third and finally the fourth prepress valve is closed.

It goes without saying that the invention can also be applied to various other configurations with different numbers of prepress valves.

I claim:

1. A baling press comprising a pressing box, a feed chute connected to the pressing box via a passage, and at least two prepress valves which are each pivotable about a pivotal axis between an open and a closed position, each prepress valve having a flat wall which in closed position closes off the passage from the feed chute to the pressing box and in opened position is disposed in the wall of the feed chute, and having a surface substantially curved around its corresponding pivotal axis, which surface in closed position closes off the passage from the feed chute to the pressing box, at least one of the prepress valves further having at least one connecting surface operatively connected and positioned between the curved surface and the flat wall which in closed position is curved around the pivotal axis of one other of the prepress valves and is adapted to the curved surface of the one other of the prepress valves, and in operation, the at least one prepress valve with the connecting surface is closed before the one other of the prepress valves is pivoted to a closed position, in such a way that in the closed position the connecting surface of the at least one prepress valve and the curved surface of the one other of the prepress valves are disposed at a mutual distance that is at most minor and substantially constant.

2. A baling press according to claim 1, provided with two oppositely disposed prepress valves, characterized in that the connecting surface is curved around the pivotal axis of the oppositely arranged prepress valve.

3. A baling press according to claim 2, characterized in that the connecting surface forms a concave cylinder sector.

4. A baling press according to claim 1, wherein in the closed position the distance between the connecting surface of the at least one prepress valve and the curved surface of the one other of the prepress valves is 20–50 mm.

5. A baling press according to claim 1, characterized by at least one screening plate mounted above at least one of said prepressing valves for hinging movement on an axis parallel to the pivotal axis, with the screening plate, when the prepress valve is in the opened position, connecting to the wall of said feed chute substantially in alignment therewith and extending at least beyond that edge of the flat wall of said prepress valve that is remote from the pivotal axis of the prepress valve and in the closed position being in contact with the curved surface of said prepress valve in a position pointing away from the feed chute.

* * * * *